United States Patent [19]

Schumann

[11] 4,283,205

[45] Aug. 11, 1981

[54] INLET FLUE SYSTEM FOR BANKS OF ELECTROSTATIC PRECIPITATOR CHAMBERS

[76] Inventor: John L. Schumann, 150 Queens Dr. South, Little Silver, N.J. 07739

[21] Appl. No.: 27,938

[22] Filed: Apr. 6, 1979

[51] Int. Cl.[3] ..... B03C 3/00

[52] U.S. Cl. ..... 55/128; 55/136; 55/343; 55/344; 55/419; 137/262; 137/545; 137/561 A

[58] Field of Search ..... 55/128–129, 55/133, 136, 343–344, 418–419; 137/262, 266, 545, 561 A

[56] References Cited

U.S. PATENT DOCUMENTS

| | | | |
|---|---|---|---|
| 1,277,691 | 9/1918 | Brantingham et al. | 55/343 |
| 1,884,501 | 10/1932 | Andrews et al. | 55/344 |
| 2,297,555 | 9/1942 | Hedberg | 55/133 X |
| 2,626,676 | 1/1953 | Phyl et al. | 55/133 |
| 3,425,189 | 2/1969 | Haselmayer | 55/129 |

FOREIGN PATENT DOCUMENTS

| | | | |
|---|---|---|---|
| 539327 | 11/1931 | Fed. Rep. of Germany | 55/133 |
| 889248 | 7/1953 | Fed. Rep. of Germany | 55/128 |
| 199336 | 6/1923 | United Kingdom | 55/418 |

*Primary Examiner*—Kathleen J. Prunner
*Attorney, Agent, or Firm*—Brumbaugh, Graves, Donohue & Raymond

[57] ABSTRACT

An inlet flue system for conducting particulate-containing gases to the inlet nozzles of a multiplicity of electrostatic precipitator chambers comprises an elongated plenum located generally above the nozzles. The plenum is substantially entirely open at the bottom, and the inlet ends of the perimeter walls of branch ducts leading from the open bottom define a series of outlet openings from the plenum. The open bottom construction leaves the plenum substantially free of upwardly facing surfaces where particulates can settle.

13 Claims, 16 Drawing Figures

INLET FLUE SYSTEM FOR BANKS OF ELECTROSTATIC PRECIPITATOR CHAMBERS

FIELD OF THE INVENTION

The present invention relates to inlet flue systems for banks of electrostatic precipitator chambers which greatly reduce or eliminate particulate settling and, therefore, several problems that result from particulate settling in conventional inlet flue systems.

BACKGROUND OF THE INVENTION

The inlet flue systems of most conventional electrostatic precipitators have many horizontal or nearly horizontal lower surfaces onto which particulates in the gases flowing to the precipitator chambers settle and accumulate. Often, the weight of the accumulated particulates builds to a level several times that of the flues themselves and requires the flues and the structures supporting them to be strong and heavy, and correspondingly costly. The settled particulates increasingly disrupt normal gas distribution by changing, usually unpredictably, the internal shapes and dimensions of the flow passages in the flues and between turning vanes. Some flow passages may even become plugged.

The tons and tons of accumulated particulates must be removed periodically. Often, removal can be accomplished only by manual shovelling, which is costly and time consuming and requires extended shutdown of an entire plant.

It is common practice in designing precipitator inlet flue systems to maintain relatively high gas flow velocities (about 50 feet per second) in order to minimize particulate settling. Reducing the gas flow from conveying velocity to precipitation velocity complicates the structures of transition sections to provide reasonably uniform distribution at the entrance to each precipitator chamber and generally involves providing multiple stages of perforated plates with attendant draft losses.

SUMMARY OF THE INVENTION

The present invention is a flue system for conducting particulate-containing gases to the inlet nozzles of a multiplicity of electrostatic precipitator chambers. The principal component of the system is an elongated plenum which is located generally above the chamber inlet nozzles. The plenum has top and side walls but is substantially entirely open at the bottom. Generally downwardly directed branch ducts lead from the bottom of the plenum to the inlet nozzles, the inlet ends of the walls of each branch duct defining an outlet opening from the plenum. The plenum, therefore, has an open bottom subdivided by the branch duct inlets into a row of longitudinally adjacent outlet openings.

The system may take numerous forms, depending upon the available ground space, size, number and arrangement of the precipitator chambers, and similar factors. One advantageous layout comprises two banks of at least two side-by-side precipitator chambers each, one bank being laterally on one side of and below the plenum and the other bank being laterally on the other side and below the plenum. With this layout of chambers the plenum may have either one or two longitudinal rows of outlet openings in the bottom. With one row of outlet openings it is advantageous to stagger the chambers of one bank longitudinally with respect to those of the other bank and to connect the outlet openings alternately, moving in the downstream direction, with the chambers of the two banks. The upstream portion of each branch duct where it leads away from the plenum outlet opening is oriented obliquely to the horizontal, adjacent branch ducts being of opposite orientations with respect to the vertical. Each branch duct then turns downwardly, preferably through an expansion section, and is connected to the inlet nozzle of the corresponding chamber.

With two longitudinal rows of outlet openings, the outlet openings of each row are connected exclusively to the chambers of one bank. Preferably, this layout will involve a symmetrical arrangement of the chambers and the outlet openings and back-to-back vertical branch ducts.

The system can be used with banks of precipitator chambers stacked one above the other, known as a "double-decked" arrangement. Preferably, the chambers of the upper deck register vertically with the chambers of the lower deck. Plenum outlet openings arranged longitudinally adjacent each other in one row are connected by branch ducts to the inlet nozzles of each chamber of the upper deck and plenum outlet openings in a second row are connected to the chambers of the lower deck. Two double-decked arrangements of opposite orientations can be installed in tandem, preferably arranged symmetrically on opposite sides of a vertical-longitudinal bisector plane of the plenum. In such a double-decked, tandem arrangement, the open bottom of the plenum is subdivided by the inlet ends of the branch ducts into four side-by-side longitudinal rows of outlet openings.

With double-decked arrangements, either single or tandem, weight and expense can be saved by providing a contraction section at the inlet end and an expansion section at the outlet end of each branch duct, particularly the branch ducts communicating the plenum with the lower deck chambers. The intermediate section of each such duct is of reduced size, weight and cost.

The lower edges of the side walls of the plenum (which define the longitudinal edges of the laterally outermost plenum outlet openings) are, preferably, parallel and lie in a horizontal plane, thereby permitting the branch ducts to be of rectangular cross section. To minimize the sizes of the walls (sides and top) of the plenum, for given cross-sectional areas along the length, the lower portions of each side wall may be oblique to the horizontal plane of the bottom edges and diverge upwardly from the bottom edges, thus to widen the plenum and reduce the height. The upper portion of the plenum may be of rectangular or "balloon" cross section. The plenum is of varying cross-sectional area along its length to provide a desired, usually a substantially uniform, distribution of gas and particulates among the several chambers.

A flue system embodying the present invention has the following advantages:

1. The most important advantage, of course, is the lack of any horizontal surfaces in the plenum where particulates might settle—the invention has, quite literally, a bottomless plenum.

2. The elimination of particulate settling and accumulation in the plenum reduces the weight and cost of the inlet plenum and duct system and the structures which support them because there is no weight of settled dust—often many times that of the plenum and ducts themselves—to be supported.

3. Elimination of particulate settling prevents gas-flow mal-distribution due to flue blockage and unpredictable changes in internal effective flue shapes and dimensions, including distorted and/or plugged turning vanes, etc.

4. Because particulate settling, which is normally kept to a minimum in conventional precipitator inlet flue systems by keeping gas velocities high (i.e., conveying velocities of about 50 fps), is eliminated, a lower gas velocity can be used in the inlet system.

5. Using lower gas velocities within the inlet plenum and flue system saves costly energy due to draft loss, which loss increases as the second power of the velocity of the gas.

6. Elimination of particulate settling within the inlet plenum and duct system saves the costs of removing tons and tons of dust. Often, such removal in conventional inlet systems can be accomplished by manual shovelling only, which is costly and time consuming requiring extended outages of whole plants.

7. The use of lower gas velocities within the inlet system improves the inherent capability of the system to divide the total gas flow equally among many outlets.

8. The use of lower gas velocities within the inlet system, combined with the opportunity to increase the size of the plenum outlet openings, enables lower gas velocities entering the ESP inlet nozzles. This earlier reduction of gas velocities from conveying velocity (about 50 fps) toward precipitation velocity (about 5 fps) can reduce draft loss due to the reduction in the need for multiple stages of perforated plates.

9. The simple geometry of the inlet plenum provides an uncomplicated and economic base on which to design, and optimize through modeling, a flow-control system of equal gas distribution and equal particulate distribution to numbers of parallel precipitator chambers.

10. The elimination of particulate settling on horizontal surfaces enables designing a flue system optimized for gas flow alone. Previous designs had to be compromised to prevent or minimize particulate settling.

11. Since all plenum outlet openings are grouped in a row or rows along the bottom of the plenum and since each outlet is fed by a simple, ninety-degree turn downward, the equal and even distribution of both gas and dust is controlled by the gas velocity at each plane of entry. This gas velocity in turn is inherently controlled by the taper of the plenum, by the heights and shapes of the baffles and by the areas of the outlets. Optimization of these inherent gas-flow-control dimensions is possible by means of three-dimensional modeling. Should modeling or subsequent field measurement indicate the need for design modification, the generous size and unencumbered interior of the plenum provide practical bases for upgrading.

12. The downward flow of gas and particulate into each ESP chamber inlet nozzle is one of the most favorable for gas-flow and particulate-flow control across the inlet plane of each ESP chamber.

13. The downward flow of gas and particulate into nested and touching ESP inlet nozzles provides an exceptionally compact arrangement of precipitators which conserves ground or other site area.

14. The location of the plenum above the precipitator casings enables economic structural support from the precipitator casing structures.

15. Since all plenum outlets are (preferably) grouped in a row or parallel rows symmetrical about the center line of the bottom of the plenum, and since all outlets require the same, simple ninety-degree turn downward, the dampering of any single chamber has a minimal effect on the distribution of gas and particulate to the parallel precipitator chambers remaining in service.

For a better understanding of the invention, reference may be made to the following description of exemplary embodiments, taken in conjunction with the figures of the accompanying drawings, all of which are schematic in form.

DESCRIPTION OF EXEMPLARY EMBODIMENTS

Figure 1:
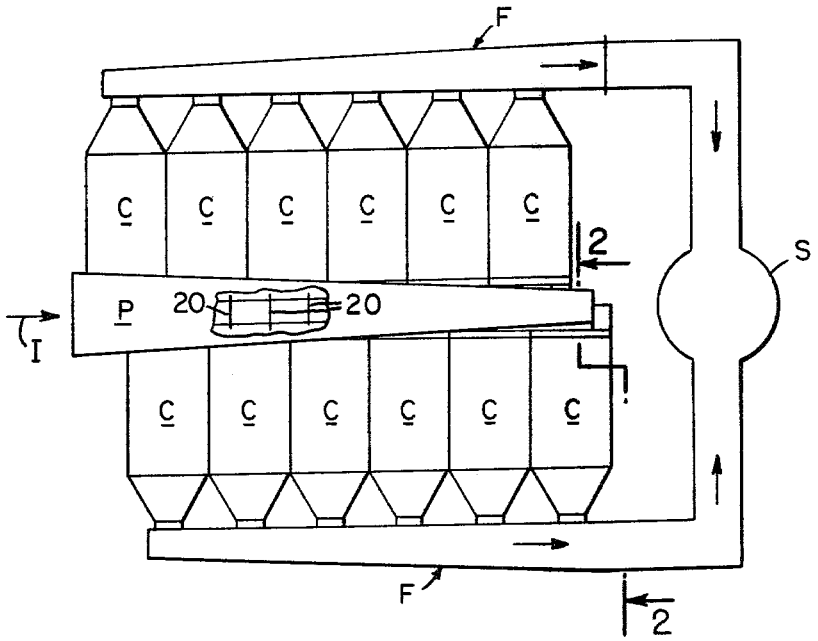
FIG. 1 is a plan view of an electrostatic precipitator having one embodiment of inlet flue system.
Figure 2:
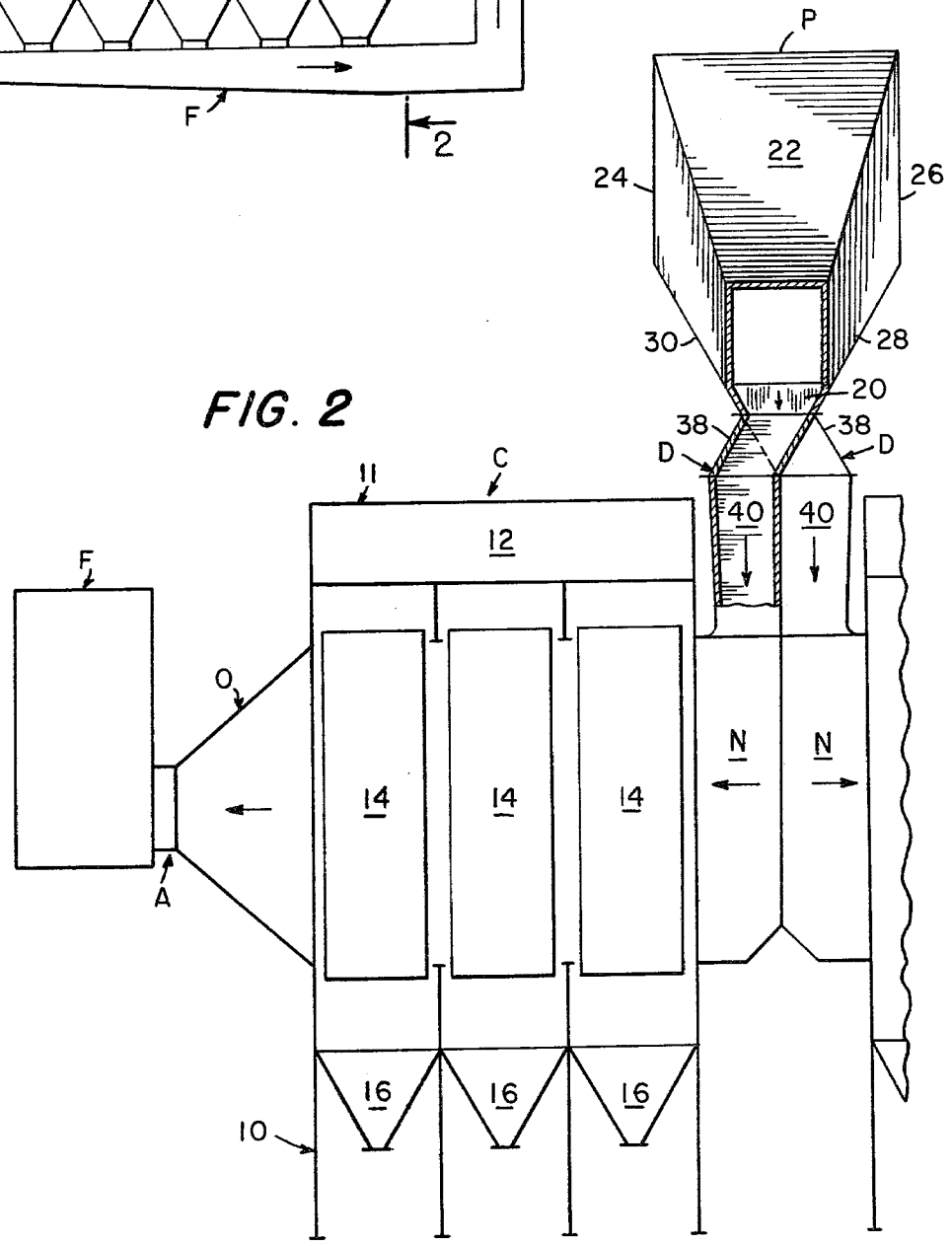
FIG. 2 is an end view of the installation of FIG. 1 taken generally along the lines 2—2 of FIG. 1 and in the direction of the arrows, a portion of the inlet system being shown in cross section.
Figure 3:
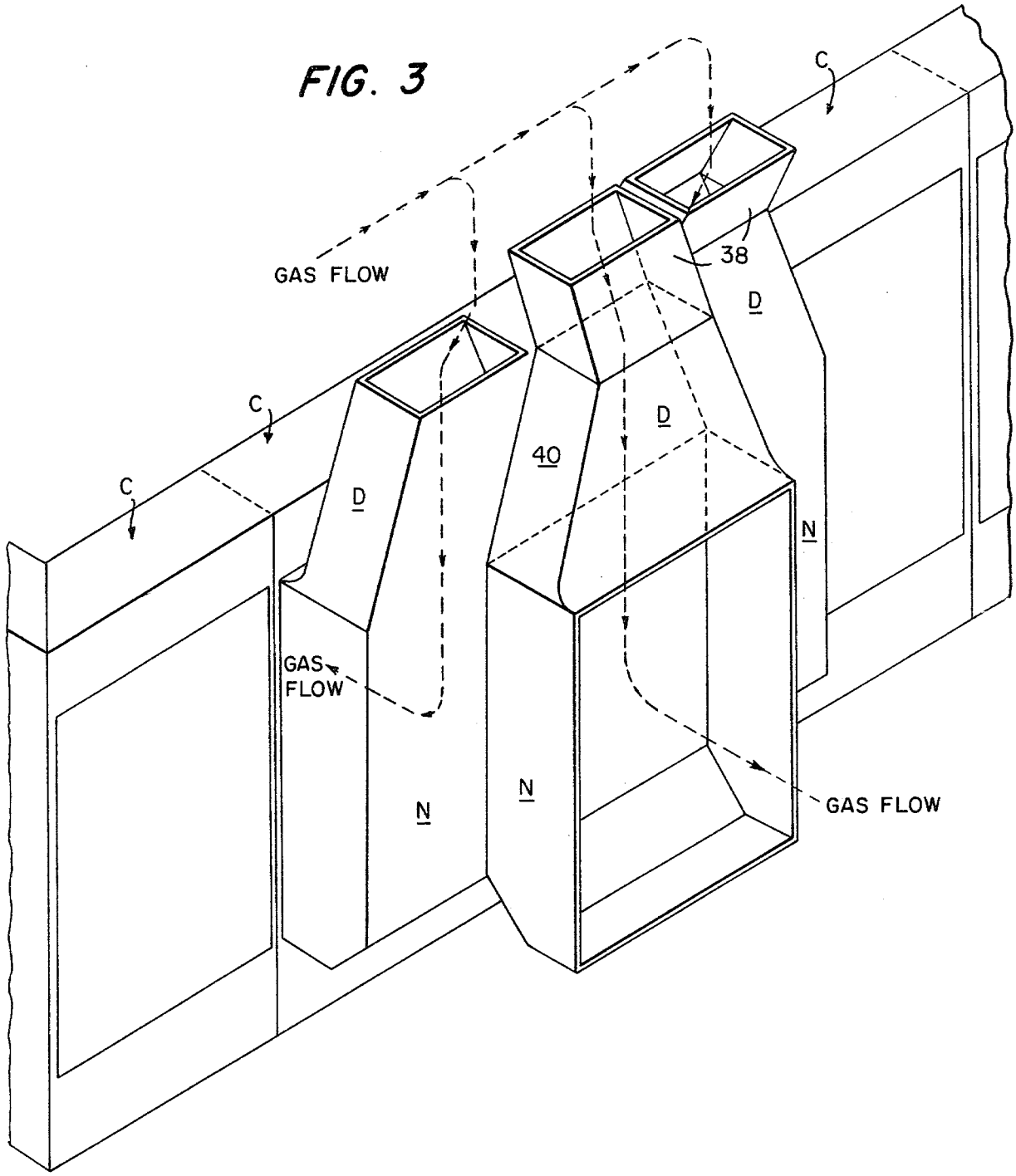
FIG. 3 is a partial pictorial view of the branch ducts, inlet nozzles and inlets of the chambers of the system shown in FIGS. 1 and 2.
Figures 4, 5, 6, 7, 8, 9:
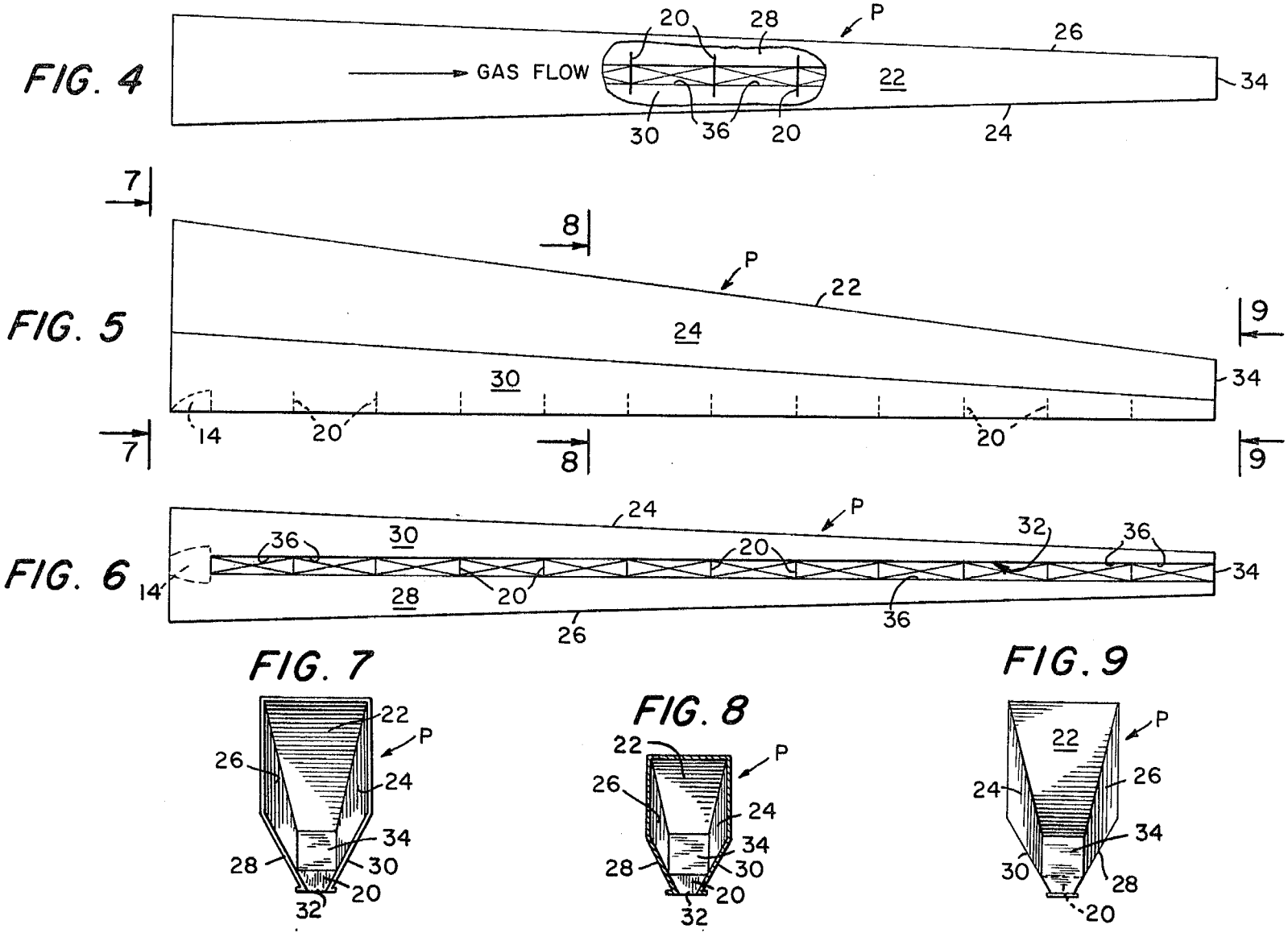
FIG. 4 is a top view of the plenum shown in FIGS. 1 to 3, a portion of the top wall being broken away.
FIG. 5 is a side elevational view of the plenum shown in FIG. 4.
FIG. 6 is a bottom view of the plenum shown in FIGS. 4 and 5.
FIGS. 7, 8 and 9 are end (and end cross-sectional) views of the plenum taken along the lines 7—7, 8—8 and 9—9 of FIG. 5 and in the direction of the arrows.

The electrostatic precipitator shown in FIGS. 1 to 9 comprises 12 precipitator chambers arranged side by side in two banks of six each. The chambers are oriented with the inlet nozzles N of the chambers of one bank back-to-back to the inlet nozzles of the chambers of the other bank, and the chambers of one bank are evenly staggered longitudinally with respect to the chambers of the other bank. Particulate-containing gases are conducted from a source, as indicated by the arrow labelled "I," to an elongated plenum P, are distributed among branch ducts D leading from the open bottom of the plenum P to the inlet nozzles N and flow through the chambers, out through outlet nozzles O to an outlet flue system F which conducts them to a stack S. Each electrostatic precipitator chamber C may be of any suitable design and will normally consist of a supporting structure 10, a casing 11, a penthouse 12, a number of electrostatic precipitation fields 14 and hoppers 16 for accumulating particulates collected in the fields.

It is desirable to provide a damper or dampers somewhere in the path of gas flow between the plenum outlet opening to the branch duct D and the outlet opening from the outlet nozzle O of each chamber so that gas flow can be interrupted by closing the damper during electrode cleaning (rapping). The stoppage of gas flow reduces rapping losses to a negligible level, increases hopper catch per rapping cycle and improves overall collection efficiency. "Dampering off" each precipitator chamber for rapping may also be done according to the present inventor's U.S. Pat. No. 3,988,127 by using two dampers to create an isolated zone into which clean gas (such as air or gas from the outlet flue) is introduced under a pressure above the ambient pressure in the chamber. The "air-lock" effect prevents even the small losses that would otherwise occur due to damper leakage. The double-dampered, pressured air-lock is conveniently installed at the outlet throat of each outlet nozzle, as indicated by the letter A ("Air-lock").

The plenums P of all four embodiments shown in the drawings are similar in that they are tapered along their entire length to reduce the cross-sectional area from a maximum at the inlet end to a minimum at the closed end. The cross-sectional area at any plane along the length of the plenum is approximately proportional to the gas flow through that plane, thereby maintaining the gas velocity within the plenum approximately constant at any selected value. The degree of taper can, however, be varied such that the gas velocity is either increased or decreased moving from the inlet toward the closed end. The selection of taper for any particular installation is a matter of design evaluation taking into account many variables, such as quantity and characteristics of the gas, quantity and characteristics of the entrained particulates, number of precipitator chambers, and the ground or other site space available. The width of the plenum outlets can be selected to provide any desired outlet gas velocity. In many cases, as is common practice in the industry, the final design selected for the precipitator installation will be optimized by a three-dimensional scale model study.

The effective taper of the plenum P is, preferably, accomplished by varying both height and width of a rectangular cross section and also varying the height of baffles 20 which separate the open bottom of the plenum into a series of outlet openings.

More particularly, as best shown in FIGS. 4 to 9, the plenums P used in the four embodiments of the drawings comprise a tapered, trapezoidal top wall 22 which slopes downwardly from the inlet end (to the left in FIGS. 4 to 6) to the closed end, a pair of upper trapezoidal side walls 24 and 26 which lie vertically, are tapered toward the closed end, and lie obliquely at a small angle to the longitudinal-vertical center plane, and a pair of lower side walls 28 and 30 which lie obliquely to a horizontal plane and taper toward the closed end. The lower side walls 28 and 30 form an elongated trough-like hopper of truncated triangular transverse cross section along the lower portion of the plenum. The lowermost edges of the side walls 28 and 30 are parallel along the entire length of the plenum, lie in a horizontal plane and thus define an open bottom 32 on the plenum that is of uniform width and extends continuously along the entire length of the plenum. As mentioned above, the width of that opening can be varied to accommodate outlet openings of the desired shapes and sizes. The downstream end of the plenum is closed by an end wall 34.

The open bottom 32 of the plenum P is subdivided into a series of outlet openings by the inlet ends of the branch ducts D which communicate the plenum with the nozzles N of the chambers C. In the embodiment shown in FIGS. 1 to 9 there is a single row of plenum outlet openings 36. Each branch duct D consists of an upper section 38 having a rectangular upper edge that is oblique to its axis and is oriented with its axis oblique to the plane of the plenum bottom, such axis lying in a transverse plane perpendicular to the axis of the plenum. Adjacent branch ducts D are right and left handed so that the lower ends of adjacent sections 38 are offset on either side of the longitudinal-vertical center plane of the plenum, thus to register longitudinally and laterally with the nozzles N. The lower end of each oblique upper inlet section 38 is connected to the upper end of an expansion section 40 of the duct D, the lower end of which opens to the upper end of a corresponding nozzle.

The positioning of the two banks of chambers with the nozzles attached back to back, the staggered relation of the chambers of the two banks, and the delivery of gas and particulates alternately to the chambers of the two banks from longitudinally adjacent outlet openings provide the advantages of using a minimum of ground or other site space, an efficient structural system of reduced weight and complexity and a simple system of ducting in which identical duct parts can be used correspondingly for all branch ducts. As described above, the gas flow characteristics can be optimized for a desired, preferably uniform, distribution of gas and particulates to the individual chambers. The baffles 20 installed between the adjacent outlet openings 36 defined by the inlet sections 38 are relatively simple components, which can be designed and optimized by modeling—such as by varying the heights and shapes—to provide the desired distribution and can be field modified relatively easily if initial operation of the precipitator suggests that changes would be beneficial. A small deflector 41 (see FIGS. 5 and 6) is installed in front of the first baffle at the inlet end of the plenum. Generally, suitable gas-flow-control vaning (not shown) will be provided at the inlet to the plenum.

Figure 10:
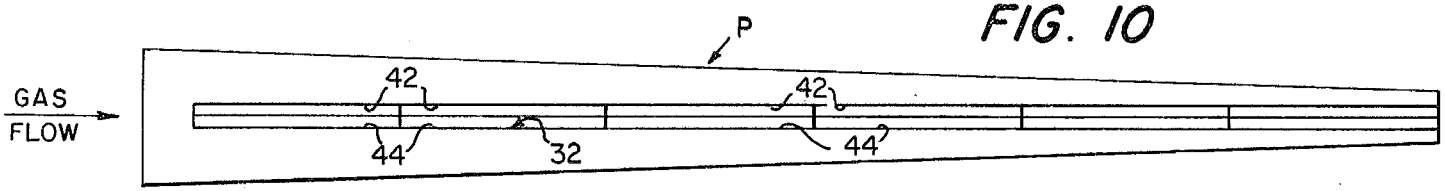
FIG. 10 is a bottom view of another embodiment of a plenum.
Figure 14:
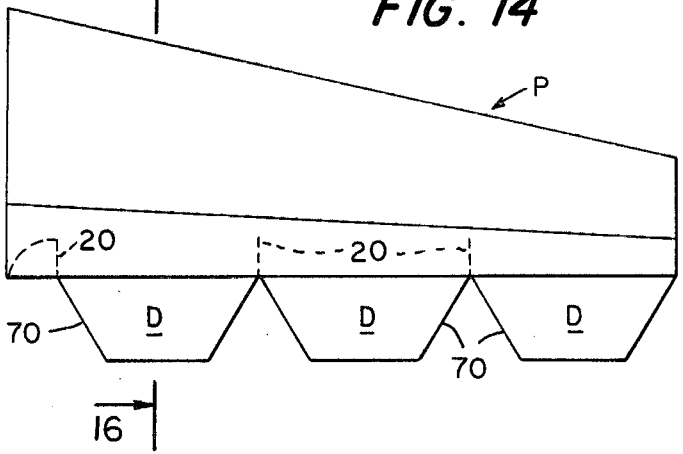
FIGS. 14, 15 and 16 are side, bottom and end cross-sectional views, respectively, of the plenum and parts of the branch ducts of the precipitator shown in FIG. 13.
Figure 15:
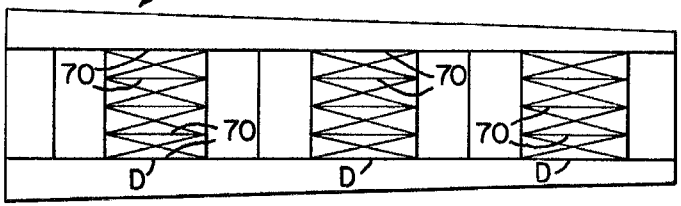

FIG. 10 shows the bottom of a modified plenum P which, though virtually identical to the plenum shown in FIGS. 1 to 9, differs in that the open bottom 32 is subdivided into two longitudinal, side-by-side rows of individual plenum outlet openings defined by the inlet ends of branch ducts. The plenum P shown in FIG. 10 is suitable for use with a symmetrical arrangement of two banks of six side-by-side chambers each on either side of a longitudinal-vertical center plane. Each outlet opening 42 in one row communicates through a corresponding branch duct to a chamber of one bank, and each outlet opening 44 in the other row communicates with a chamber of the other bank. Such an arrangement has all of the advantages of the arrangement shown in FIGS. 1 to 9, except that the cross section of each branch duct, though simpler, provides a higher ratio of cross-section perimeter to area and may be slightly less efficient in terms of duct metal work and weight.

Figure 12:
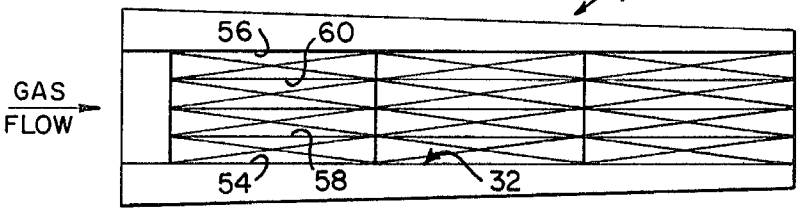
FIG. 12 is a bottom view of the plenum of the FIG. 11 precipitator.
Figure 16:
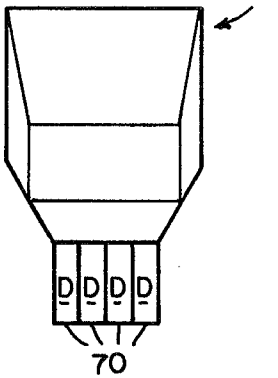
Figure 11:
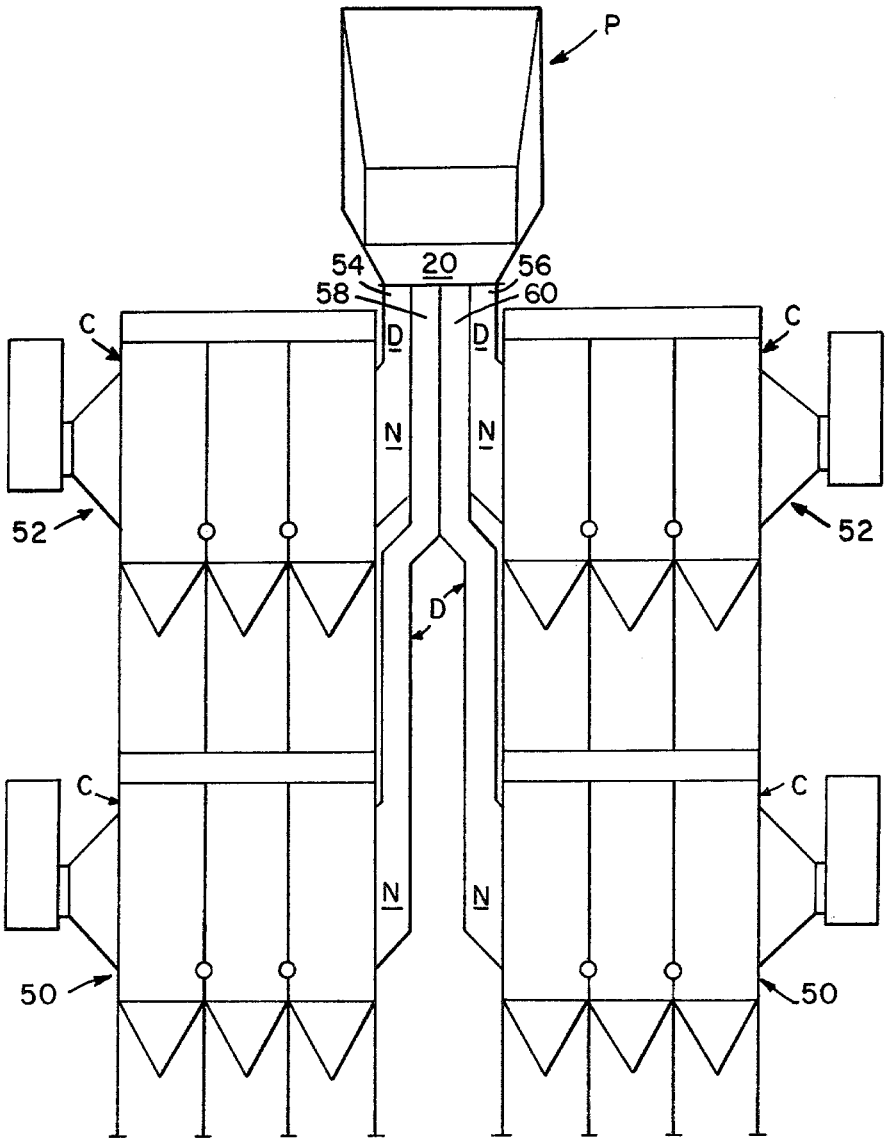
FIG. 11 is an end elevational view of a double-decked, tandem installation.
Figure 13:
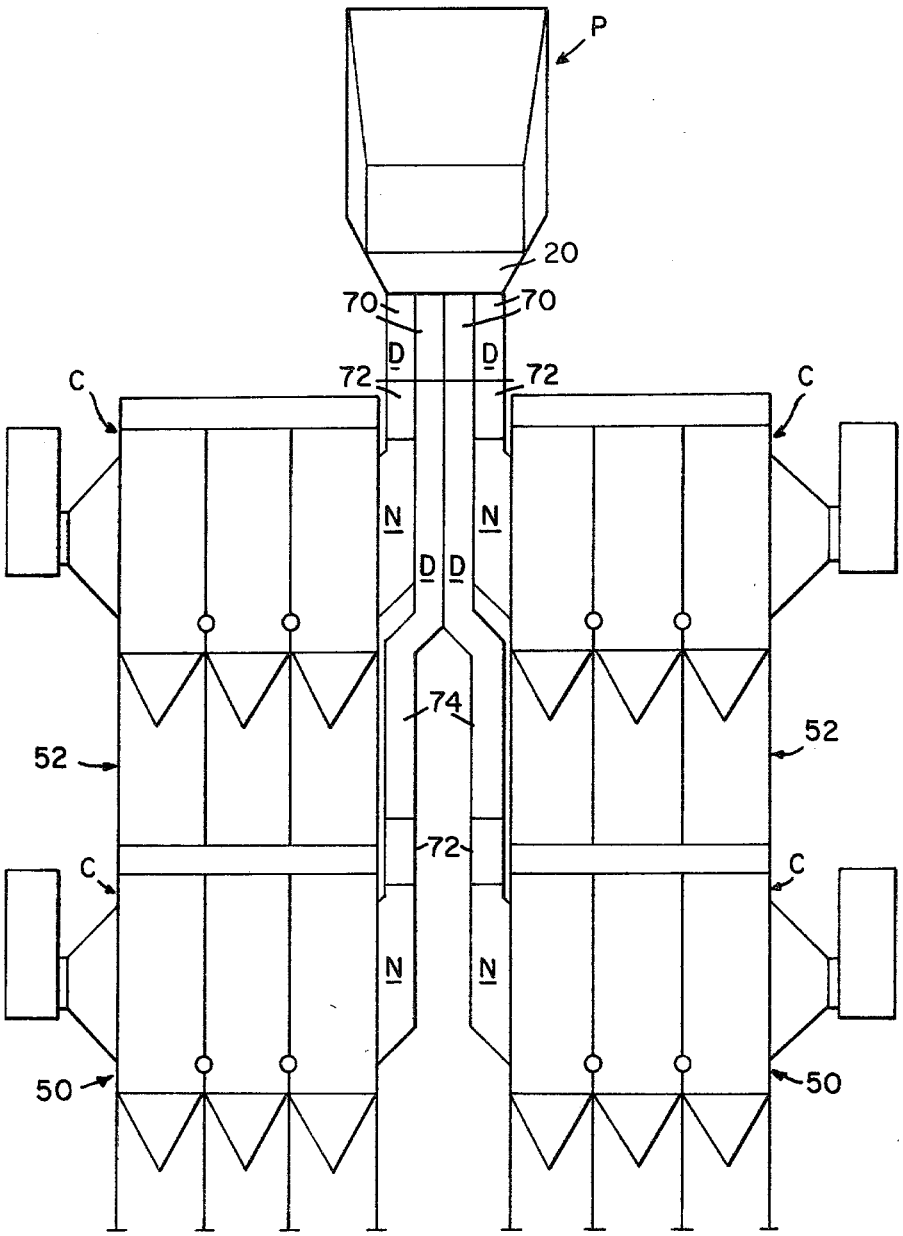
FIG. 13 is an end elevational view of another double-decked, tandem precipitator.

The electrostatic precipitator shown in FIGS. 11 and 12 includes a tandem arrangement of double-decked units. Each double-decked unit comprises a lower bank 50 and an upper bank 52 of three side-by-side chambers each stacked in vertical register. The overall construction and geometry of the plenum P are the same as those of the plenum of FIGS. 1 to 9, except that the open bottom 32 is much wider and the plenum is shorter. The outlet openings are arranged in four longitudinal, side-by-side rows of three openings each, as defined by the back-to-back upper ends of branch ducts; to wit, the laterally outermost rows of branch ducts 54 and 56 lead straight down to the corresponding nozzles of the upper banks of chambers 52, and the remaining two rows of branch ducts 58 and 60 lead downwardly from the plenum, are offset laterally and then lead down the rest of the way to the corresponding nozzles of the chambers of the lower banks 50. The longitudinal dimension of each duct (longitudinal with respect to the axis of the plenum) may be uniform throughout the height of the duct and may be equal to the longitudinal dimension of the opening to the nozzle, as shown in FIGS. 11 and 12.

The precipitator shown in FIGS. 13 to 16 has an arrangement of upper and lower banks 52 and 50, respectively, of chambers in double-decked, tandem relationship that is identical to the arrangement shown in FIGS. 11 and 12, and the plenum is very similar to the plenum shown in FIGS. 11 to 12. However, each branch duct includes a contraction section 70 at the inlet end, an expansion section 72 at the lower end, and in the case of the branch ducts leading to the lower banks 50, a "downcomer" section 74 connected between the contraction and expansion sections 70 and 72. This embodiment is exemplary of modifications that can be made in the design of the branch ducts to provide flow control or achieve economy, or both. In this instance, the reduced cross section of each "downcomer" section 74 significantly reduces the weight and cost of the duct system.

The above-described embodiments of the invention are merely exemplary, and numerous variations and modifications will be readily apparent to those skilled in the art without departing from the spirit and scope of the invention.

I claim:

1. An inlet flue system for conducting particulate-containing gases to the inlet nozzles of a multiplicity of electrostatic precipitator chambers comprising an elongated plenum located generally above and laterally of the nozzles and associated precipitator chambers and having top and side walls and being substantially entirely open at the bottom, the bottom being essentially free of upwardly facing horizontal or substantially horizontal surfaces where particulates might settle out and collect, and a generally downwardly directed branch duct leading from the bottom of the plenum directly to each inlet nozzle for substantially downward flow of the gases directly to the respective inlet nozzles without substantial settlement and collection of particulates in the plenum or ducts, the inlet end of the perimeter walls of each branch duct defining an outlet opening from the plenum.

2. A system according to claim 1 and further comprising a transverse baffle in the lower portion of the plenum between each pair of adjacent outlet openings.

3. A system according to claim 1 wherein the bottom of the plenum has at least one row of longitudinally adjacent outlet openings.

4. A system according to claim 3 wherein there are two banks of at least two side-by-side precipitator chambers each, one bank being laterally on one side of and below the plenum and the other bank being laterally on the other side of and below the plenum, and wherein adjacent plenum outlet openings communicate the plenum with one chamber of each bank.

5. A system according to claim 4 wherein the chambers of one bank are staggered longitudinally with respect to those of the other bank, and the branch ducts leading to the chambers are oblique to the horizontal, adjacent branch ducts being of opposite orientations with respect to the vertical.

6. A system according to claim 5 wherein the inlet nozzles of the chambers of one bank are back to back with the nozzles of the chambers of the other bank and the inlet nozzles are located symmetrically with respect to the vertical center plane of the plenum.

7. A system according to claim 6 and further comprising an expansion section in each branch duct.

8. A system according to claim 6 wherein the inlet nozzles of the chambers of each bank are laterally adjacent each other and evenly staggered with respect to the nozzles of the other bank.

9. A system according to claim 1 wherein there are at least two laterally adjacent rows of plenum outlet openings and at least two banks of at least two side-by-side precipitator chambers each, the banks being on either side of a longitudinal-vertical center plane, and wherein the outlet openings of one row communicate with the chambers of one bank and the outlet openings of the other row communicate with the chambers of the other bank.

10. A system according to claim 1 wherein there are at least two banks of at least two side-by-side precipitator chambers each, the chambers of one bank being mounted generally above the chambers of the other bank.

11. A system according to claim 10 wherein there are two laterally adjacent rows of plenum outlet openings and the openings of one row communicate with the chambers of one bank and the openings of the other row communicate with the chambers of the other bank.

12. A system according to claim 1 wherein there are four banks of at least two side-by-side precipitator chambers, each, including two lower banks and two upper banks mounted generally above the lower banks so as to define a double-decked arrangement on either side of a longitudinal-vertical center plane, and wherein there are four laterally adjacent rows of plenum outlet openings, the openings of each row communicating with the chambers of one bank exclusively.

13. A system according to claim 1 wherein the lower edges of the side walls of the plenum are parallel and lie in a horizontal plane and each side wall includes a lower portion oriented obliquely to the horizontal plane and diverging upwardly from the bottom.

* * * * *